United States Patent [19]

Sakamaki et al.

[11] Patent Number: 4,498,853

[45] Date of Patent: Feb. 12, 1985

[54] VANE-TYPE COMPRESSOR

[75] Inventors: Hiroshi Sakamaki, Tochigi; Yukio Suzuki, Saitama, both of Japan

[73] Assignee: Nippon Piston Ring Co., Ltd., Tokyo, Japan

[21] Appl. No.: 214,394

[22] Filed: Dec. 8, 1980

[30] Foreign Application Priority Data

Dec. 14, 1979 [JP] Japan ..... 54-172390[U]

[51] Int. Cl.[3] ..... F01C 1/00; F02C 2/00

[52] U.S. Cl. ..... 418/268; 418/267; 417/310

[58] Field of Search ..... 417/310; 418/267, 268, 418/76

[56] References Cited

U.S. PATENT DOCUMENTS

| | | | |
|---|---|---|---|
| 3,216,363 | 11/1965 | Snow et al. | 103/136 |
| 3,252,423 | 5/1966 | Whitmore et al. | 103/120 |
| 3,254,570 | 6/1966 | Mazur | 418/268 |
| 3,255,704 | 6/1966 | Mazur | 418/268 |
| 3,272,139 | 9/1966 | Rosaen | 103/120 |
| 3,311,064 | 3/1967 | Eichele et al. | 103/136 |
| 3,447,477 | 6/1969 | Pettibone | 418/268 |
| 4,104,010 | 8/1978 | Shibuya | 418/76 |

FOREIGN PATENT DOCUMENTS 53-4483 2/1978 Japan .

*Primary Examiner*—Ronald B. Cox

*Attorney, Agent, or Firm*—Sughrue, Mion, Zinn, Macpeak and Seas

[57] ABSTRACT

A vane-type compressor of the lubrication type in which pressure applied to vane bottoms is controlled to prevent vane breakage and excessive wear. A rotor is disposed between a rotor housing and a pair of side housings with vanes slidingly disposed within corresponding vane grooves radially formed in the rotor. Intake fluid pressure is applied to spaced defined between each of the grooves and the bottom of the corresponding vanes during suction strokes through a first arcuate groove. A second arcuate groove is formed in an inner surface of the side housings at a position corresponding to the spaces during compression strokes. A pressure discharge passage connected to the arcuate groove and an outlet port is provided and a check valve is provided in the pressure discharge passage.

5 Claims, 6 Drawing Figures

VANE-TYPE COMPRESSOR

BACKGROUND OF THE INVENTION

The invention relates to a vane-type compressor for use in an air conditioner and a cooling device in an automobile. A vane-type compressor of this general type is compact and does not create excessive vibration and noise.

FIGS. 1 through 3 show a conventional vane-type compressor which was constructed with a view of enhancing compression efficiency. In this compressor, an arcuate groove 8 is formed in an inner surface of a side housing 6. The arcuate groove 8 is in fluid communication with a space 211 defined by vane grooves 21 formed in a rotor 2 and bottoms 31 of vanes 21 slidingly disposed therein. This fluid communication is accomplished during the suction stroke of the pump at which time fluid pressure is applied to the bottom 31 of the vane 3 through an intake port 4, a fluid passage 7 formed in the side housing 6, a check valve 11 and the arcuate groove 8 to thus prevent the space 211 from being at a negative pressure. As a result, the sliding performance of vanes is improved to thus enhance the compression efficiency and abnormal wear of the inner surface of a rotor housing is avoided.

However, such a construction has drawbacks as follows.

During the suction stroke, the vane bottoms 31 are subject to intake fluid pressure from the intake port 4 through the fluid passage 7, check valve 11, and the arcuate groove 8. In this case, when the vanes go into a compression stroke following an intake stroke by the rotation of the rotor 2, the intake fluid pressure supplied into the space 211 of the vane groove is extremely high until the exhaust stroke. Accordingly, the pressure applied to the vane bottoms 31 is large thereby causing the vanes to be abnormally worn or even to be broken. Particularly, in the vane-type compressor of the lubrication type, the above-described drawback becomes significant since oil is mixed with Freon TM gas (coolant) for lubrication and this mixture is subjected to intake compression and exhaust strokes. Such lubricating oil is compressed within a working chamber during the compression stroke. Since the oil is non-compressive liquid, vane 3 is not sufficiently radially inwardly displaceable within the vane groove due to the oil accumulation at the vane bottom during compression stroke. As a result, rotation of the rotor may be prevented, and the vanes may be broken.

SUMMARY OF THE INVENTION

It is, therefore, an object of the invention to overcome the above-described drawbacks and to provide an improved vane-type compressor.

Another object of the invention is to provide such vane-type compressor in which abnormal wear of the vanes is prevented.

Still another object of the invention is to provide such a compressor of the lubrication type in which breakage of vanes due to abnormally high pressure in the working chamber during the compression stroke caused by the pressurization of the lubrication oil is eliminated.

Still further object of the invention is to improve volmetric efficiency of the vane-type compressor, yet exhibiting sufficient sliding movement of the vanes relative to the vane grooves.

These and other objects are attained in accordance with the present invention by providing an additional arcuate groove at the inner side wall of the side housing. The additional arcuate groove is positioned to provide fluid communication with vane groove spaces when those spaces are in the compression stroke. The arcuate groove is in fluid communication with an outlet port through a fluid discharge passage having a check valve operatively disposed therein.

DESCRIPTION OF THE PREFERRED EMBODIMENTS

Figure 1:
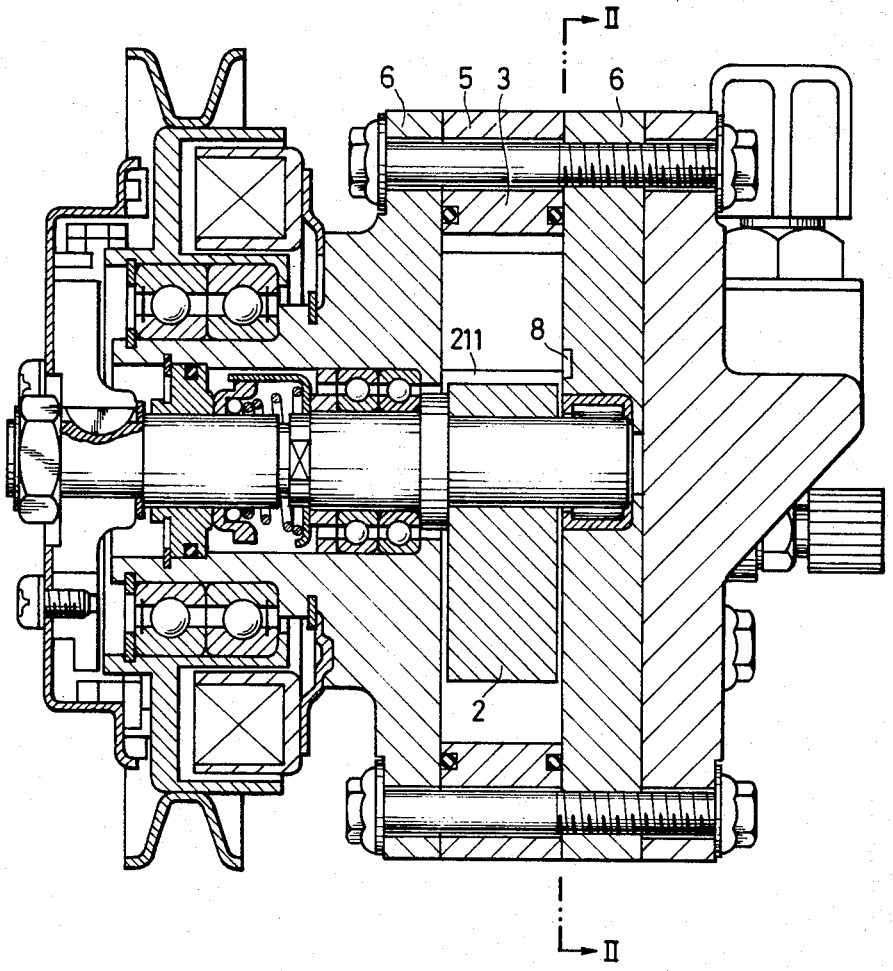
FIG. 1 shows a cross-sectional view of a conventional vane-type compressor.
Figure 2:
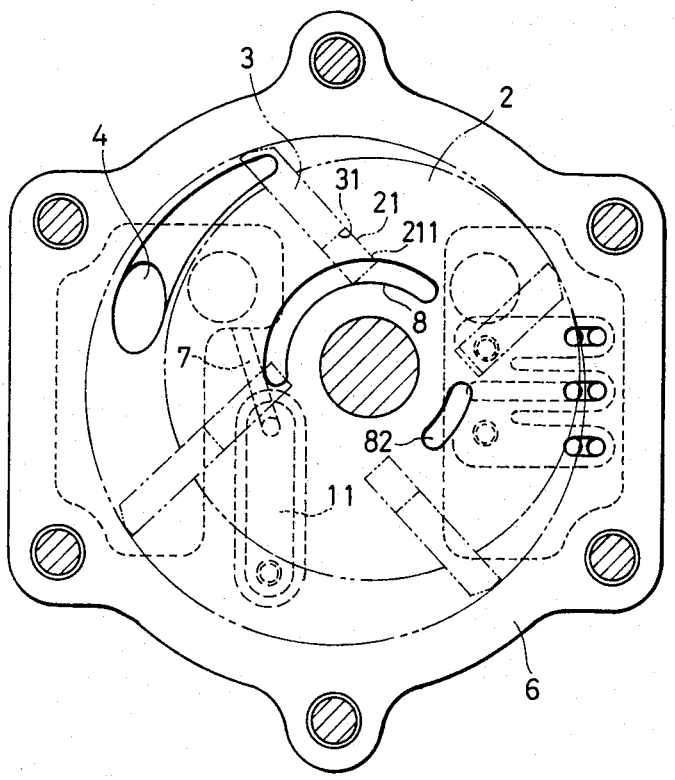
FIG. 2 shows a cross-sectional view taken along the line II—II in FIG. 1.
Figure 3:
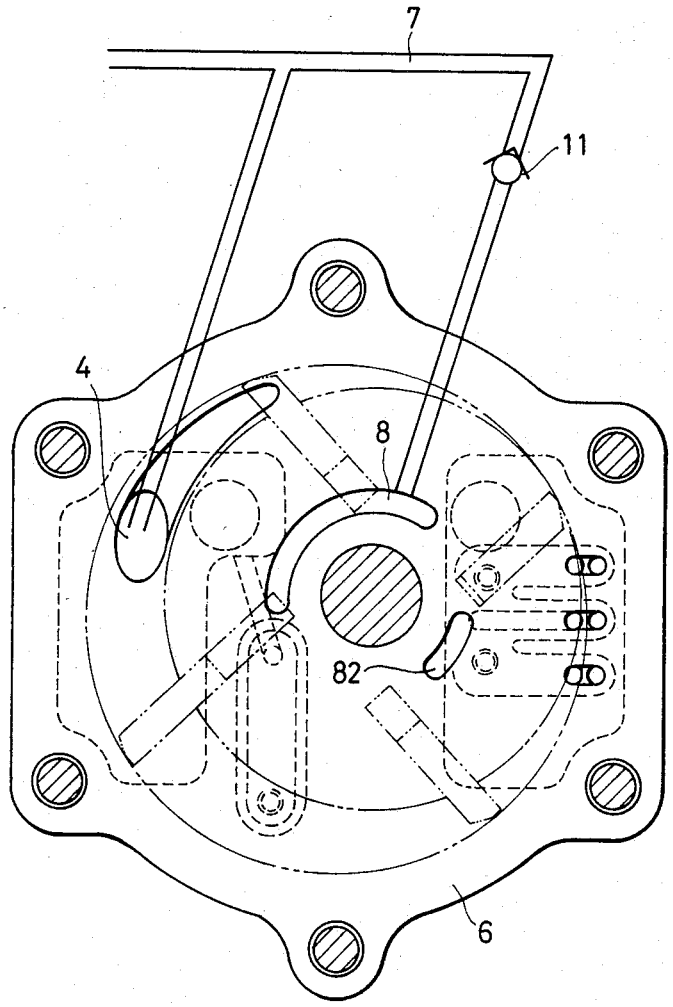
FIG. 3 is an explanatory illustration showing fluid communication in the compressor shown in FIGS. 1 and 2.
Figure 4:
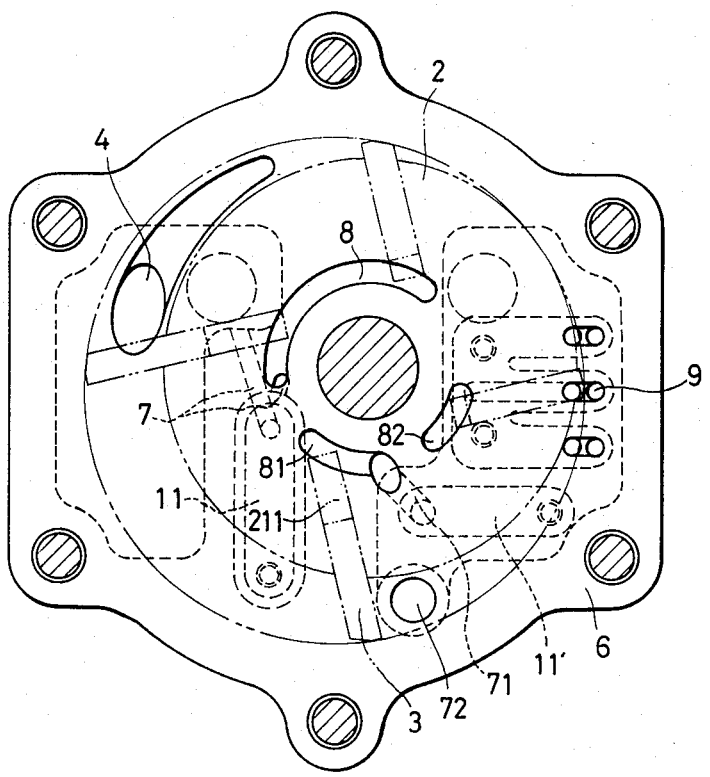
FIG. 4 is a cross-sectional view showing a vane-type compressor according to a first embodiment of the present invention.
Figure 5:
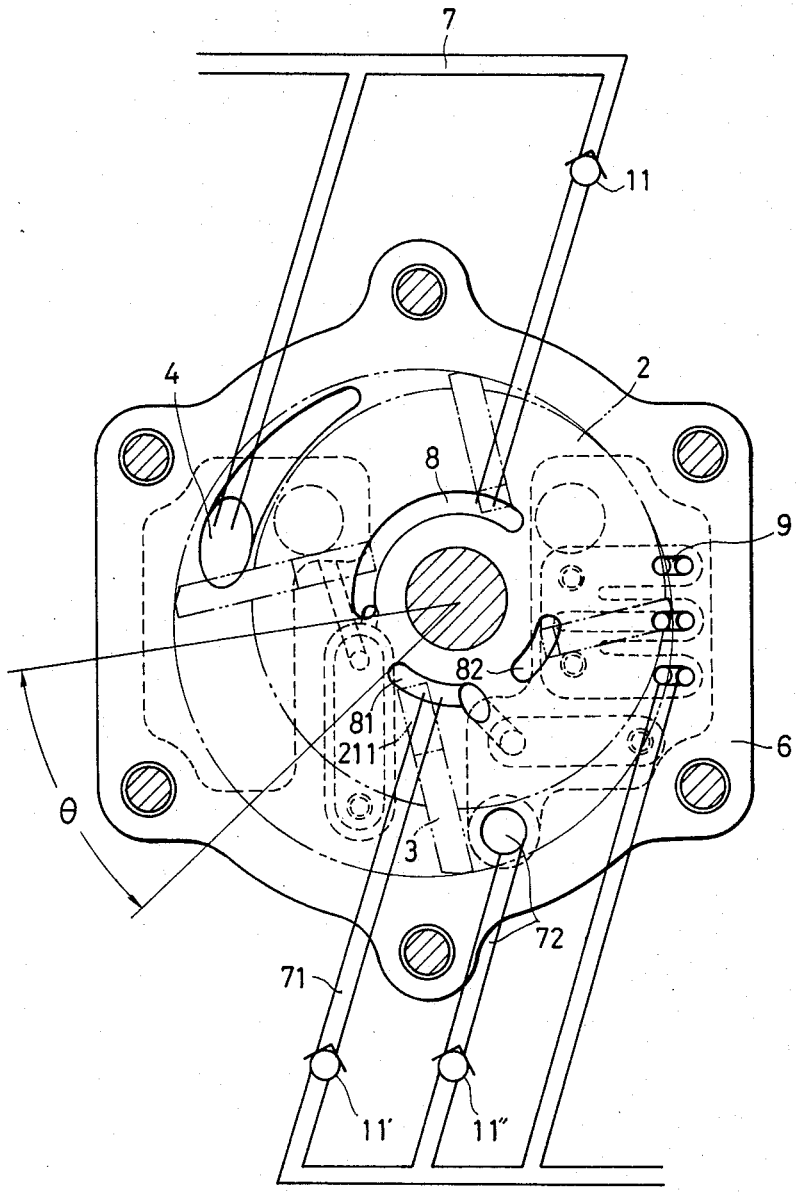
FIG. 5 is an explanatory illustration showing fluid communication in the compressor of the first embodiment of the invention.

A first embodiment of the present invention is shown in FIGS. 4 and 5. In this compressor, an arcuate groove 8 is in fluid communication with a suction port 4 during the suction stroke through a fluid passage 7. This much of the structure is the same as that of the conventional compressor shown in FIGS. 1 through 3. A rotor 2 is rotatably disposed within a rotor chamber defined between a rotor housing 5 and a pair of side housings 6. The rotor 2 is radially provided with vane grooves. Rotation of the rotor and vanes 3 performs fluid intake, compression and discharge operations.

In accordance with the present invention, an additional arcuate groove 81 is formed in an inner surface of a side housing. The arcuate groove 81 is at a position corresponding to a vane groove space 211 during the compression stroke. Further, a pressure discharge passage 71 is provided between the arcuate groove 81 and an outlet port 9. The discharge passage 71 is provided with a check valve 11' so as to avoid reverse flow of the discharging pressure. The discharge passage 71 preferably provides relatively large cross-section in order to smoothly discharge lubrication oil.

With this structure, even though the intake fluid pressure applied to the vane groove space 211 during the suction stroke becomes extremely large in the subsequent compression stroke, the increasing pressure in the space 211 can be discharged into the outlet port 9 through the arcuate groove 81, check valve 11', and the discharge passage 71 since the check valve 11' can be opened before the fluid pressure at which damage to the vanes is caused. In this case, the pressure applied to the vane bottom 31 becomes much higher than the outlet pressure, particularly in a compressor of the lubrciation type, since the compressor of the lubrication type employs lubrication oil together with Freon TM gas as a coolant and since this mixture is subjected to intake, compression and exhaust strokes so that oil can enter the vane groove space 211 and cause an undesired increase in pressure in the space. The high pressure can be discharged from the space upon reaching a predetermined pressure by automatic opening of the check valve 11'. As a result, since an abnormally high pressure increase in the vane groove space 211 can be prevented and since the lubrication oil can be promptly discharged therefrom, breakage of the vanes is avoided. The check valve 11' prevents the outlet pressure at the outlet port 9 from being applied to the space 211 through the fluid discharge passage 71 and the arcuate groove 81.

Figure 6:
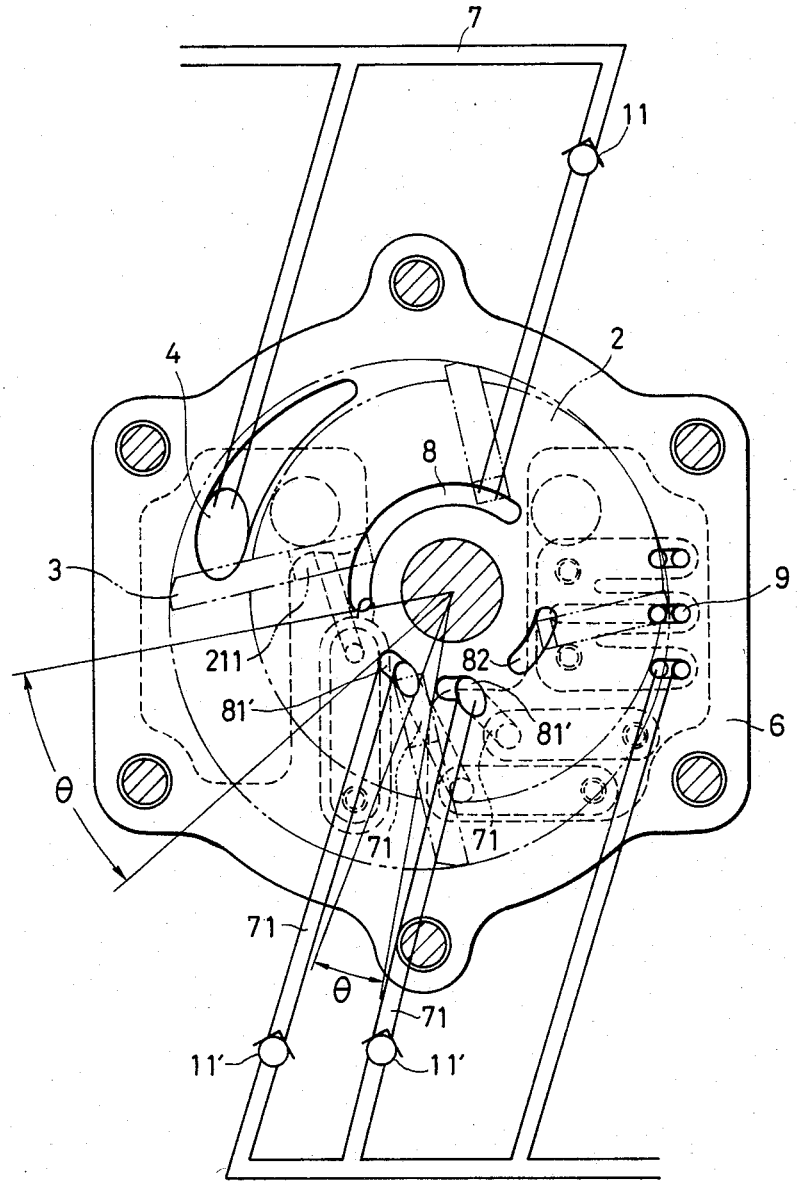
FIG. 6 is a cross-sectional view with a fluid communication diagram showing a vane-type compressor according to a second embodiment of the present invention.

FIG. 6 shows a second embodiment of a vane-type compressor according to the invention in which a pair of subdivided arcuate grooves 81' are formed at positions corresponding to the compression stroke so as to provide fluid communication with the vane groove spaces. In this case, one of the arcuate grooves 81' is connected to the pressure discharge passage 71 and the other to check valve 11' to thus apply an acceptable pressure to the vane bottoms.

Further, the distance between neighboring arcuate grooves 81' in the circumferential direction and the circumferential distance between the arcuate groove 81 for the compression stroke and the arcuate groove 8 for the suction stroke is in a range of 5° to 35°.

The angle $\theta$ is indicated in FIGS. 5 and 6 in which a radial line connecting the center of the shaft and the downstream end of one groove and a radial line connecting the center of the shaft and the upstream end of the other groove define the angle $\theta$. If the angle $\theta$ is less than 5°, the neighboring arcuate grooves are too closely positioned so that the pressure supplied into the vane groove space 211 is the same for both suction and compression strokes. As a result, proper pressure may not be applied to the vane bottom 31 and further the vane action may not be properly carried out in response to the applied pressure in the vane groove space 211. On the other hand, if the angle $\theta$ exceeds 35°, the circumferential distance between neighboring arcuate grooves becomes too large. Therefore, the fluid pressure in the vane groove space 211 becomes excessively large during the period between suction and compression strokes (between the position at which vane passes over the arcuate groove 8 and the position at which vane is about to reach the arcuate groove 81). As a result, a proper pressure applied to vane bottom 31 may not be obtainable.

Further, for a vane-type compressor of the lubrication type, in addition to the problem of the increase in the pressure within the vane groove space, there is another problem, namely, an abnormal pressure increase in the working chamber. That is, the working chamber during the compression stroke has an extremely high internal pressure due to the compression of the lubrication oil and therefore vanes may be broken. Thus, the problem of abnormal pressure increase in the working chamber during the compression stroke in a vane-type compressor of the lubrication type must be resolved.

In accordance with the present invention, this problem is eliminated by providing an additional pressure discharge passage 72. The discharge passage 72 has one end opened to the working chamber during the compression stroke. The opening of the passage 72 is formed in the side housing at a position confronting the working chamber during the compression stroke. The other end is connected to the outlet port 9. The discharge port 72 is provided with a check valve 11''. Upon an abrupt increase in the internal pressure in the working chamber due to compression of the lubrication oil, the increased pressure urges the check valve 11' to open so as to allow the pressure to be discharged into the outlet port 9 through the discharge passage 72. Thus, the abrupt pressure increase in the working chamber during the compression stroke is remarkably eliminated and vane breakage is avoided.

The check valve 11'' is provided in order to avoid backflow of the outlet pressure into the working chamber through the discharge passage 72 to thereby eliminate vane breakage and to eliminate reduction of pumping efficiencies. The check valve 11'' may be a reed valve which is easily produced. However, a ball valve or any equivalent valve can be used.

Incidentally, according to the present invention, arcuate grooves 8 and 81 are provided at the position corresponding to vane suction and compression strokes, respectively, as disclosed above. Further, at the vane-exhaust stroke regions, it is preferable to provide still another arcuate groove 82 in fluid communication with the outlet port 9, as shown in FIGS. 2 through 6. The groove 82 is formed in the inner surface of the side housing at the position corresponding to spaces 211 during exhaust strokes. Therefore, any liquid introduced into the vane groove bottom 211 during suction stroke region can be discharged into the outlet port 9 through the check valve 11' at compression stroke region, if abnormally high pressure is generated at this stroke. On the other hand, if abnormally high pressure is not generated within the vane groove at the compression stroke, the liquid is subject to compression within the arcuate groove 81 during compression stroke, and thereafter, the liquid can be discharged to the outlet port 9 through the arcuate groove 82 during exhaust stroke. Therefore volmetric efficiency of the vane-type compressor is further enhanced, because of the pumping function at the vane groove bottom 211.

As is apparent from the foregoing, according to the vane-type compressor of the invention, since an arcuate groove is formed on the inner side of the side housing at a position corresponding to the rotational locus of the vane groove space in the compression stroke region, and since the arcuate groove is in fluid communication with the outlet port through the discharge passage and the check valve, an abnormal pressure increase within the vane groove space is prevented. This eliminates disadvantages such as breakage of the vanes and provides improved vane-type compressor results.

Further, in the case of a vane-type compressor of the lubrication type, an abnormal pressure increase within the working chamber during the compression stroke is prevented since an additional pressure discharge passage is provided which opens at the inner surface of the side housing which confronts the working chamber during the compression stroke. The additional pressure discharge passage is connected to the outlet port to discharge the increased pressure thereinto. Therefore, the high pressure within the vane groove space and working chamber is discharged into the outlet port to thereby eliminate drawbacks such as the breakage of vanes. Therefore, the vane type compressor of the invention provides a high efficiency and long service life. Further, volmetric efficiency of the vane-type compressor can be further promoted by providing the additional groove 82 at the position corresponding to vane-exhaust stroke region.

What is claimed is:

1. A vane-type compressor comprising: a rotor housing; a pair of side housings; a rotor rotatably disposed within a rotor chamber defined between said rotor housing and said pair of side housings; a plurality of vanes slidably disposed within corresponding vane grooves radially formed in said rotor; means for applying intake fluid pressure to spaces defined between each said vane groove and a bottom of the corresponding vane during suction strokes, said pressure being applied through a first arcuate groove, a second arcuate groove being formed in an inner surface of said side housing at a position corresponding to said spaces during compression strokes, a pressure discharge passage connecting said second arcuate groove and an outlet port; and a check valve provided in said pressure discharge passage, wherein said second arcuate groove is subdivided into a plurality of grooves, each of said plurality of grooves being connected to a corresponding one of said pressure discharge passages and check valves.

2. A vane-type compressor comprising: a rotor housing; a pair of side housings; a rotor rotatably disposed within a rotor chamber defined between said rotor housing and said pair of side housings; a plurality of vanes slidingly disposed within corresponding vane grooves radially formed in said rotor; means for applying intake fluid pressure to spaces defined between each said vane groove and a bottom of the corresponding vane during suction strokes, said pressure being applied through a first arcuate groove, a second arcuate groove being formed in an inner surface of said side housing at a position corresponding to said spaces during compression strokes, a pressure discharge passage connecting said second arcuate groove and an outlet port; and a check valve provided in said pressure discharge passage, and further comprising a third arcuate groove formed in the inner surface of said side housing at a position corresponding to said spaces during exhaust strokes, said third arcuate groove being in fluid communication with said outlet port.

3. The compressor of claim 1 wherein an additional pressure discharge passage is provided having one end opened to said inner surface portion of said side housing, said inner surface portion being at a position corresponding to a working chamber during compression strokes, and further comprising a check valve provided in said additional pressure discharge passage for preventing backflow of said pressure discharged from said working chamber.

4. The compressor of claim 1 wherein the angle between ends of said plurality of arcuate grooves forming said second arcuate groove is in a range of 5° to 35°.

5. The compressor of claim 1 wherein the angle between ends of said first and second arcuate grooves is in a range of 5° to 35°.

* * * * *